US012319484B2

(12) United States Patent
Ham et al.

(10) Patent No.: US 12,319,484 B2
(45) Date of Patent: Jun. 3, 2025

(54) ONE-TOUCH-REMOVABLE CONTAINER PACKAGING FILM, AND CONTAINER COMPRISING SAME

(71) Applicants: Sang Jin Ham, Namyangju-si (KR); Dong Min Jang, Wonju-si (KR)

(72) Inventors: Sang Jin Ham, Namyangju-si (KR); Dong Min Jang, Wonju-si (KR)

( * ) Notice: Subject to any disclaimer, the term of this patent is extended or adjusted under 35 U.S.C. 154(b) by 0 days.

(21) Appl. No.: 18/280,633

(22) PCT Filed: Mar. 28, 2022

(86) PCT No.: PCT/KR2022/004318
§ 371 (c)(1),
(2) Date: Sep. 6, 2023

(87) PCT Pub. No.: WO2022/211412
PCT Pub. Date: Oct. 6, 2022

(65) Prior Publication Data

US 2024/0158150 A1 May 16, 2024

(30) Foreign Application Priority Data

Mar. 31, 2021 (KR) ..... 10-2021-0042067

(51) Int. Cl.
*B65D 71/00* (2006.01)
*B65D 71/04* (2006.01)

(52) U.S. Cl.
CPC ..... *B65D 71/04* (2013.01)

(58) Field of Classification Search
CPC .... B65D 25/2873; B65D 55/06; B65D 71/02; G09F 3/10; G09F 3/0292; G09F 2003/0251
See application file for complete search history.

(56) References Cited

U.S. PATENT DOCUMENTS 4,382,506 A 5/1983 Chaussadas
4,873,193 A * 10/1989 Jensen ..... B01L 3/508 422/549

(Continued)

FOREIGN PATENT DOCUMENTS

JP H07-112760 A 5/1995
KR 10-1935459 B1 1/2019

(Continued)

*Primary Examiner* — Eyamindae C Jallow
(74) *Attorney, Agent, or Firm* — KORUS Patent, LLC; Seong Il Jeong

(57) ABSTRACT

The present invention relates to a one-touch-removable container packaging film, and a container comprising same and, more specifically, to a one-touch-removable container packaging film, and a container comprising same, the packaging film: being naturally removable from the container when a container lid is rotatably separated from a container body in order to open contents sealed in the container, so as to be forcibly removed from the container according to the opening of the container contents without the need to consciously remove the packaging film in order to recycle the used container, and thus inconvenient actions such as removal of the packaging film during disposal of the container can be fundamentally eliminated; being forcibly removable according to the opening of the container contents so that the packaging film is necessarily removed from the container after the container is used even if the packaging film is not intended to be removed; and being easily removable with only a one-touch rotational operation of the lid so that the separation and discharge of the packaging film can be conveniently induced.

3 Claims, 14 Drawing Sheets

(56) References Cited

U.S. PATENT DOCUMENTS

| | | | | | |
|---|---|---|---|---|---|
| 5,411,295 | A * | 5/1995 | Bates | G09F 3/0292 | 283/105 |
| 5,605,230 | A * | 2/1997 | Marino, Jr. | B65D 55/026 | 40/310 |
| 6,343,695 | B1 * | 2/2002 | Petrick | G09F 3/0292 | 283/81 |
| 2020/0071042 | A1 * | 3/2020 | Hanan | B65D 41/3404 | |

FOREIGN PATENT DOCUMENTS

| | | | |
|---|---|---|---|
| KR | 10-2026585 | B1 | 9/2019 |
| KR | 20-2020-0000522 | U | 3/2020 |
| KR | 10-2020-0115398 | A | 10/2020 |

* cited by examiner

ONE-TOUCH-REMOVABLE CONTAINER PACKAGING FILM, AND CONTAINER COMPRISING SAME

TECHNICAL FIELD

The present invention relates to a one-touch-removable container packaging film, and a container comprising same and, more specifically, to a one-touch-removable container packaging film, and a container comprising same, the packaging film: being naturally removable from the container when a container lid is rotatably separated from a container body in order to open contents sealed in the container, so as to be forcibly removed from the container according to the opening of the container contents without the need to consciously remove the packaging film in order to recycle the used container, and thus inconvenient actions such as removal of the packaging film during disposal of the container can be fundamentally eliminated; being forcibly removable according to the opening of the container contents so that the packaging film is necessarily removed from the container after the container is used even if the packaging film is not intended to be removed; and being easily removable with only a one-touch rotational operation of the lid so that the separation and discharge of the packaging film can be conveniently induced.

BACKGROUND ART

Disposable containers are mostly recycled after a single use. However, most of such containers are attached to the surface of the packaging film that serves to provide information such as advertising phrases, ingredients and contents of the substances contained in the container, wherein the packaging film is generally made of a material different from that of the container body, and cannot go through the same recycling process as the container.

Generally, the packaging film of the container is formed by printing the printed contents on both sides of the coated paper or film type side, and an oil-based adhesive is sometimes used to adhere it to the container.

At this time, disposable containers are mostly made of a polyester resin, while the packaging film, which is an attachment, is a resin film made of polypropylene and polyvinyl chloride, so it is inevitable to separate it when recycling the container.

Conventionally, when separating such a container and a resin film attached to the outer surface of the container, that is, the packaging film, since the container and the packaging film have the same specific gravity, the separation operation by the specific gravity separation method is impossible. Furthermore, as described above, when the material is polypropylene, the packaging film is completely fixed to the outer surface of the container with an adhesive, which makes it very difficult to remove it, and there is no choice but to rely on manual work and expensive equipment, which results in excessive consumption of work hours, labor costs, etc., thus making it unprofitable, and faced an unrealizable problem in terms of container recycling.

In addition, since most packaging films do not have a structure that can be easily removed, it is difficult and complicated to separate and remove them from the outer surface of the container. If the packaging films are mixed and cleaned with recycled materials as they are, the recycled materials contain foreign matter, which will reduce the quality of the materials. When a large amount of the foreign matter is present, the separated material must be disposed of, which poses a fatal problem that the container cannot be recycled.

Therefore, in order to recycle the container, first, the work of completely removing the packaging film from the container body and classifying it must be preceded.

However, in the case of users of disposable containers, it is cumbersome to peel off the packaging film one by one when disposing of the containers, so they are being discharged as they are. Recycling companies are currently burdened with pretreatment work to remove packaging film from containers one by one.

In other words, it is a reality that a large amount of manpower is unnecessarily invested in recycling containers, and this is not reasonable even in light of the purpose of recycling.

DETAILED DESCRIPTION OF THE INVENTION

Technical Problem

Therefore, the present invention has been designed to solve the above problems, and an object of the present invention is to provide a one-touch-removable container packaging film, and a container comprising same, the packaging film: being naturally removable from the container when a container lid is rotatably separated from a container body in order to open contents sealed in the container, so as to be forcibly removed from the container according to the opening of the container contents without the need to consciously remove the packaging film in order to recycle the used container, and thus inconvenient actions such as removal of the packaging film during disposal of the container can be fundamentally eliminated; being forcibly removable according to the opening of the container contents so that the packaging film is necessarily removed from the container after the container is used even if the packaging film is not intended to be removed; and being easily removable with only a one-touch rotational operation of the lid so that the separation and discharge of the packaging film can be conveniently induced.

Technical Solution

In order to achieve the above object, according to the present invention, there is provided a packaging film that wraps the outer side of the container, wherein: the packaging film is made in the form of a closed band that is wound in a direction of interconnecting the upper surface of the container lid and the lower surface of the container body, and forms an adhesive point at either one of the lid and the body, and is separated from the container when the lid is rotated.

Also, the surface of the packaging film is printed with an advertising phrase for the substance contained in the container.

Further, the packaging film comprises an upper end portion that forms the upper portion of the packaging film and wraps around the outer side of the container lid; and a middle portion formed at the lower portion of the upper end portion and wrapping the outer side of the container body, wherein the perforated line constitutes a boundary point between the upper end portion and the middle portion, and wherein the full width of the middle portion is formed larger than the full width of the upper end portion.

Further, the packaging film is closely adhered to the surface of the container by heat shrinkage.

In addition, the adhesive means is formed only at a point corresponding to the upper surface of the container lid.

Advantageous Effects

According to the present invention, the packaging film can be naturally removed from the container when a container lid is rotatably separated from a container body in order to open contents sealed in the container, so as to be forcibly removed from the container according to the opening of the container contents without the need to consciously remove the packaging film in order to recycle the used container, and thus inconvenient actions such as removal of the packaging film during disposal of the container can be fundamentally eliminated; the packaging film can be forcibly removed according to the opening of the container contents so that the packaging film is necessarily removed from the container after the container is used even if the packaging film is not intended to be removed; and it can be easily removed with only a one-touch rotational operation of the lid so that the separation and discharge of the packaging film can be conveniently induced.

DETAILED DESCRIPTION OF THE EMBODIMENTS

Figure 1B:
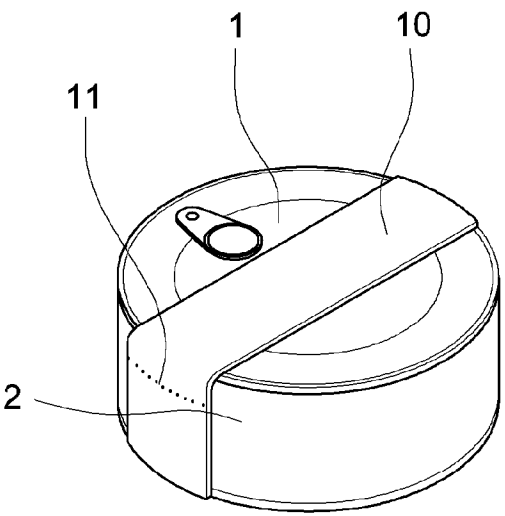
FIGS. 1A-1B are diagrams showing the configuration of a container according to the present invention.

For a more complete understanding of the invention, preferred embodiments of the invention will be described with reference to the accompanying drawings. Embodiments of the present invention may be modified in various forms, and the scope of the present invention should not be construed as being limited to the examples described in detail below. Rather, the embodiments are provided so that this invention will be explained more fully to those of average knowledge in the art. Therefore, the shapes of elements in the drawings may be exaggerated to emphasize a clearer description. It should be noted that in each drawing, the same members are sometimes indicated by the same reference numerals. Detailed descriptions of well-known functions and configurations that are judged to unnecessarily obscure the subject matter of the present invention are omitted.

The present invention provides a container packaging film 10 (hereinafter referred to as packaging film 10 and a container including the same, which film wraps around the outer side of the container so as to serve to provide information such as the ingredients and content of substances contained in the container, advertising phrases, trademarks, etc., in which when the container lid 1 is connected to the container body 2 before the contents sealed in the container are unsealed, it functions as a packaging means by holding the state of wrapping the outside of the container. When the container lid 1 is rotated and separated from the container body 2 in order to unseal the contents sealed in the container, the lid 1 is cut in conjunction with the rotating direction and is naturally removed from the container. For the recycling of used containers, the packaging film 10 can be forcibly removed from the container by opening the contents of the container, even if the packaging film 10 does not have to be intentionally removed, so that the separation and discharge of the packaging film 10 can be conveniently induced.

That is, the packaging film 10 according to the present invention has a structure in which the packaging film 10 can be easily removed by a one-touch rotating operation of the lid 1, so that inconvenient actions such as intentional removal of the packaging film 10 during disposal of the container can be fundamentally eliminated, and the packaging film can be forcibly removed according to the opening of the container contents so that the packaging film 10 can be necessarily removed from the container after the container is used even if the packaging film 10 is not intended to be removed.

A container according to the present invention can be generally defined as comprising a body 2, a lid 1 coupled to the upper end of said body 2, and a packaging film 10 that wraps the body 2 and the lid 1 together.

The container in the present invention may be understood as a concept encompassing various container structures such as bottles and cans. For example, the body 2 in the preferred embodiment consists of a conventional bottle structure with a bottle opening on the upper end, and the lid 1 may be detachably coupled to the bottle mouth, and may have a cylindrical structure that opens and closes the interior of the body 2.

Figure 1A:
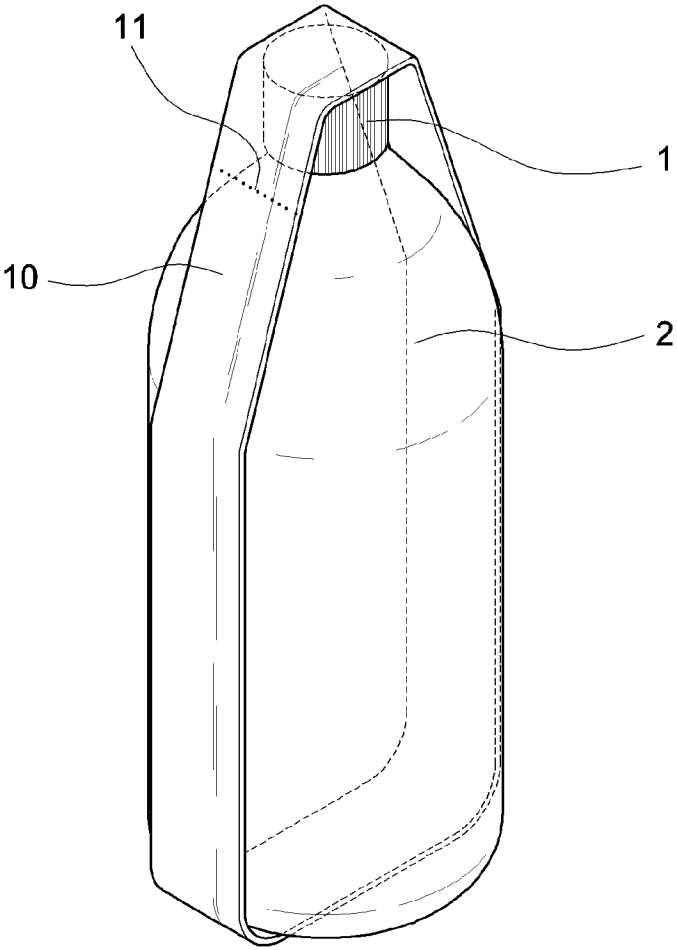
Figure 2:
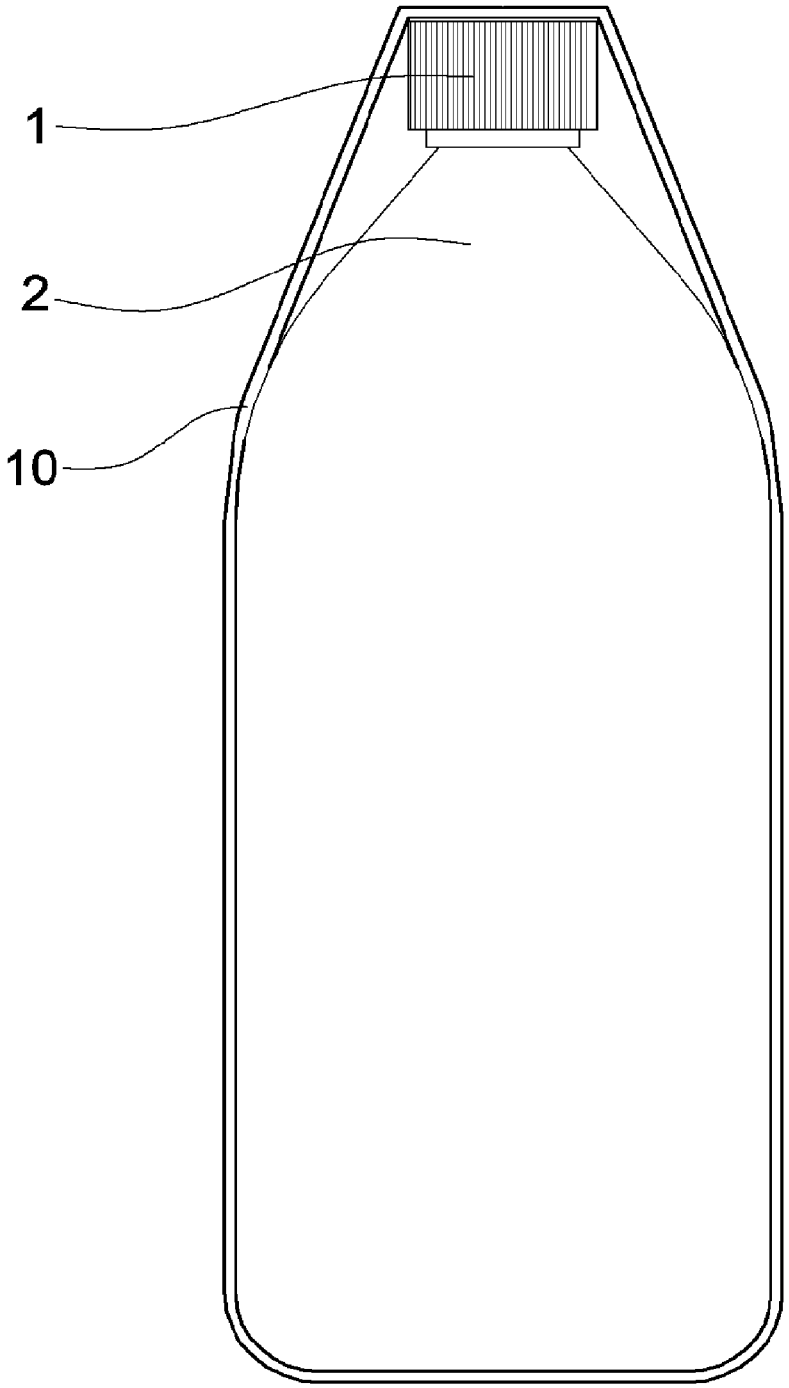
FIGS. 2 and 3 are diagrams showing one side of FIG. 1A.
Figure 3:
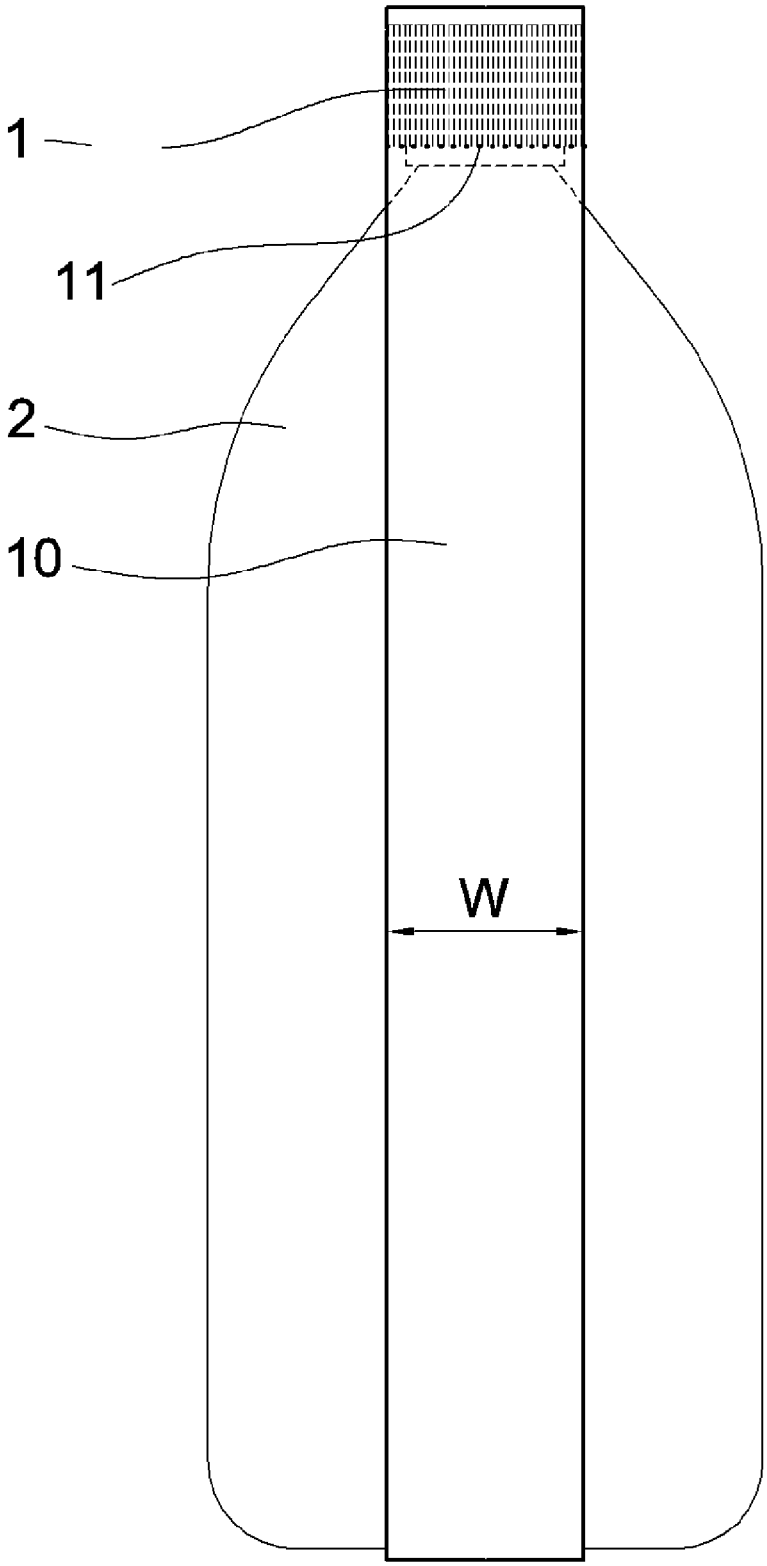
Figure 4:
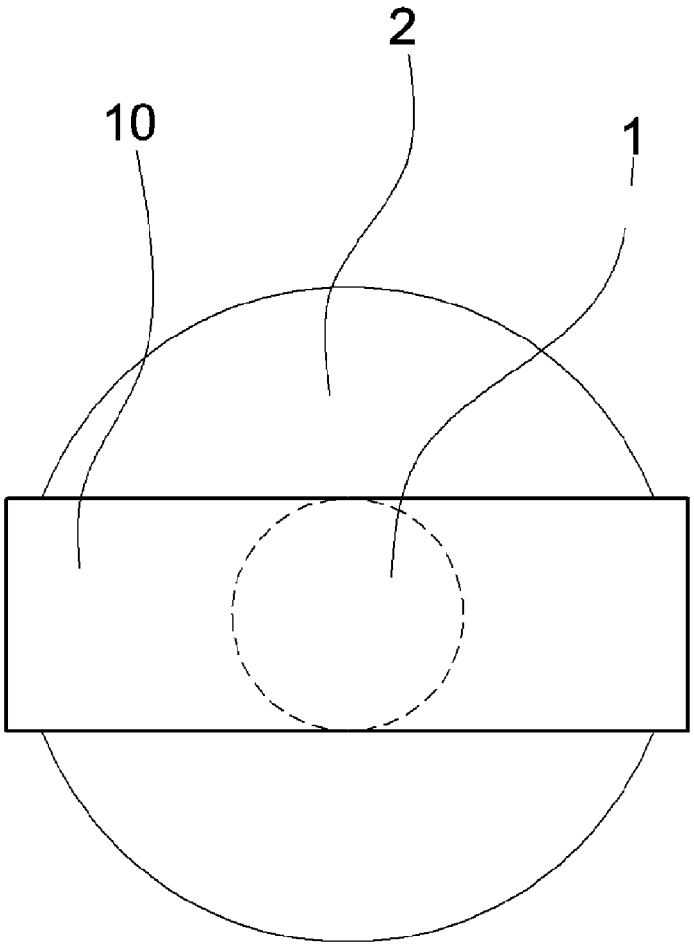
FIG. 4 is a plan view of FIG. 1A.
Figure 5:
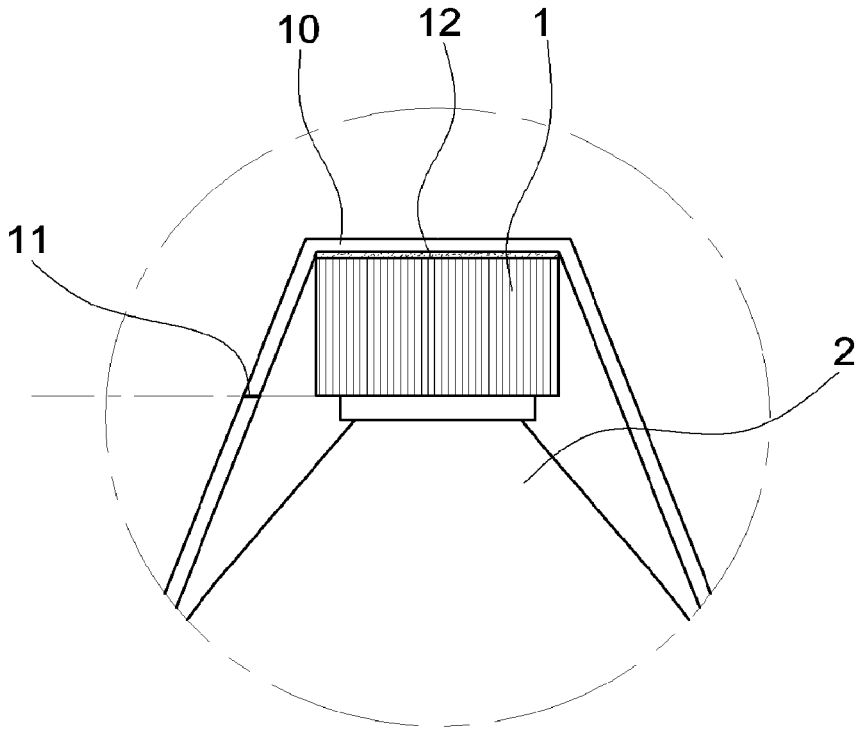
FIG. 5 is an enlarged view of the main part of the present invention.
Figure 6:
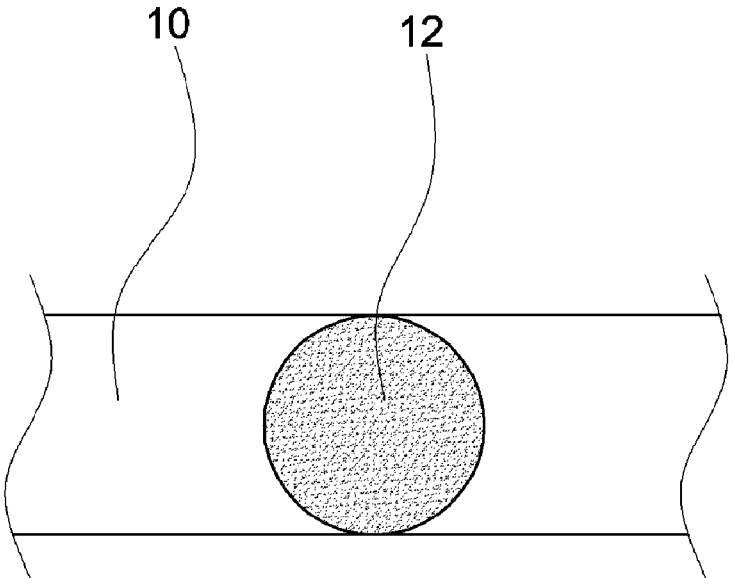
FIG. 6 is a diagram which schematically shows one side of the packaging film on which the adhesive means is formed.

In some cases, the container may be exemplified by a can-shaped container comprising a lid 1 and a body 2, as shown in FIG. 1B, but for convenience of explanation, the packaging film 10 applied to the general bottle-shaped container shown in FIG. 1A will be mainly described below.

Since the main feature of the present invention is the packaging film 10, the structure of the packaging film 10 will be described in detail below.

First, as shown in FIGS. 1A to 4, the packaging film 10 according to the present invention is formed in the form of a single closed band wound in the direction of interconnecting the upper surface of the container lid 1 and the lower surface of the container body 2, so that an adhesive point is formed on either one of the lid 1 and the body 2 to be separated from the container when the lid is rotated.

For example, the packaging film 10 is provided with an adhesive means 12 on the inner surface that is in contact with the container lid 1, is attached and fixed to the outer surface of the lid 1, and is provided with a perforated line 11 on the path, so that when the lid 1 is rotated, the perforated line 11 portion can be cut and separated from the container.

Ordinary packaging film is generally wound around the outer peripheral surface of the middle portion of the container body 2, but in this case, a small amount of adhesive is applied between the container and the packaging film to fix the packaging film to the outer surface of the container body 2 so that the packaging film is firmly fixed to the container.

Accordingly, after using the entire container, the user cuts a part of the packaging film with a separate knife or scissors in order to remove the packaging film before recycling, and the portion attached to the container by the adhesive forcibly peels off by grabbing the packaging film. At this time, due to the excessive adhesive force of the adhesive, a considerable amount of the packaging film that has not been peeled off from the container body 2 remains on the outer surface of the container body 2 where the adhesive is applied. In this case, there is a limit to removing the adhered residue only by human hands, and there are cases in which separate chemical treatment or cleaning is required.

However, the packaging film 10 according to the present invention has a structure that is not wrapped along the circumference of the container body 2, similar to the conventional packaging film, but is wound in a direction of interconnecting the upper surface of the container lid 1 and the bottom surface of the container body 2, and at the same time, the adhesive means 12 is not attached to the container body 2, but only adhesively fixed to the lid 1 so that no residue is left on the body 2 when removed from the container, and sufficient fixing power is ensured, and also, when the lid 1 rotates, its path is segmented based on the perforated line 11 to be more conveniently removed from the container.

More specifically, the packaging film 10 according to the present invention has a structure of continuously winding the upper surface of the lid 1, the lower surface of the body 2, and both facing sides of the body 2, and both facing sides of the body 2 that are not wrapped around the packaging film 10 can be completely opened.

In addition, since the packaging film 10 does not have a structure that winds along the circumference of the body 2, the packaging film 10 can be made flatter and various information printed on the packaging film 10 can be displayed without distortion. In addition, it is possible to improve the visibility of various types of information.

The perforated line 11 is a means for guiding the packaging film 10 so that the path of the packaging film 10 is easily cut, and may be exemplified as piercing fine dots and forming a line. That is, when the packaging film 10 is cut along the perforated line 11, the path of the packaging film 10 can be easily and completely segmented.

In the basic embodiment, only one perforated line 11 is formed, but in some cases, it is an alternative configuration that may be formed as a pair at a position facing each other or may not be formed at all.

On the other hand, when the container lid 1 is rotated and separated from the container body 2 in order to unseal the contents sealed in the container, the packaging film 10 itself is twisted outside the container with the lid 1 as the twist center point. When the packaging film 10 is twisted in this way, cutting is induced at the perforated line 11, and at this time, considering the speed of cutting, the formation position of the perforated line 11 is formed on the same line as the lower end of the container lid 1.

When the packaging film 10 is twisted in conjunction with the rotation of the lid 1, the twisting force is transmitted weakly toward the lower portion away from the lid 1. Thus, if the perforated line 11 is relatively biased toward the lower end of the body 2, for example, the lid 1 may be twisted and cut by rotating it about once, but there arises a problem that cutting of the packaging film 10 cannot be made more intuitively.

On the other hand, when the perforated line 11 is formed on the same line as the lower end of the lid 1 as in the present embodiment, when the lid 1 is rotated, the packaging film 10 is immediately cut at the portion of the perforated line 11 that is twisted by the rotation. Thus, the packaging film 10 can be cut more intuitively, so that the removal efficiency of the packaging film 10 is improved.

In some cases, a notch 11' may be applied to the packaging film in place of the perforated line 11.

Figure 9:
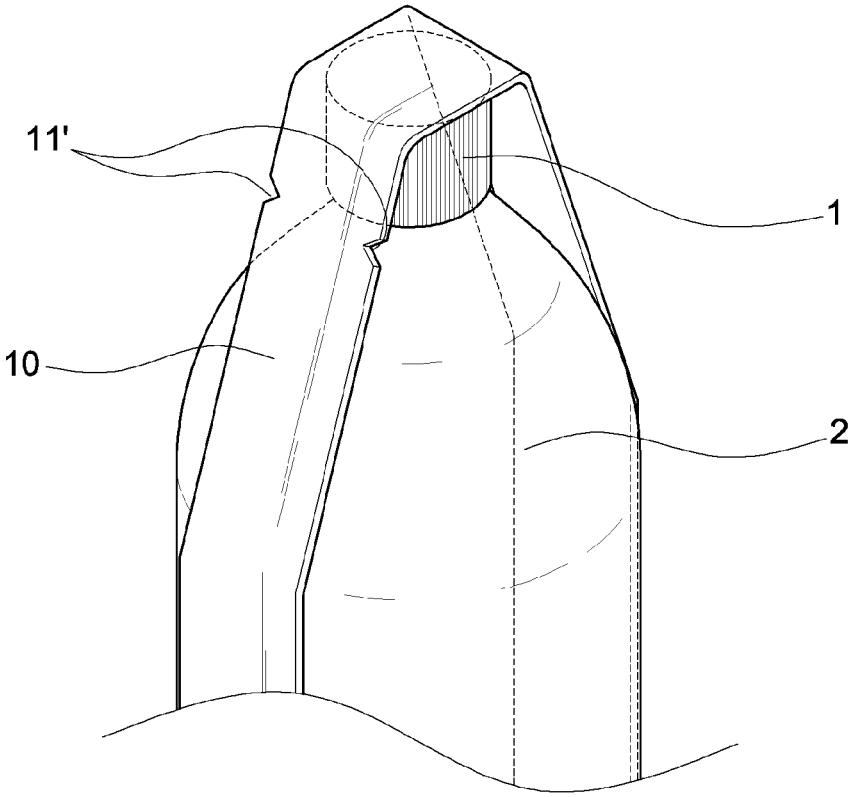
FIG. 9 is a diagram showing a container to which a notch is applied.

As shown in FIG. 9, the notch is formed in a triangular shape toward the center in the width direction from the end portion of the packaging film 10 in the width direction to a predetermined depth, and may guide cutting of the packaging film 10.

At this time, the notches 11' may be provided in a pair so as to be symmetrical to each other at the ends of the packaging film 10 in the width direction facing each other. At this time, a pair of notches 11' facing each other may be formed on the same line with each other.

Figure 10:
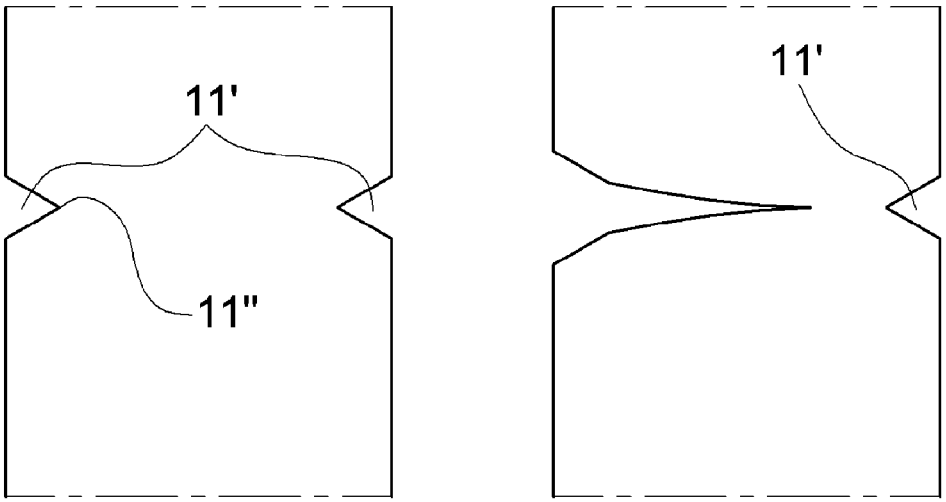
FIG. 10 is a diagram which illustratively illustrates a process of cutting the packaging film through a notch.

That is, when the user rotates the lid 1, as shown in FIG. 10, the cutting of the packaging film 10 is guided based on the vertex 11" of at least one of the notches 11', so that the cutting can be completed at the vertex 11" of the other notch 11'.

Therefore, since the cutting line can be formed in a uniform straight direction connecting the pair of notches 11', it is possible to prevent a phenomenon in which the packaging film 10 is cut in an unspecified direction during the cutting process, and the cutting is not cleanly performed.

Since the notch 11' is recessed at the end portion of the packaging film 10 in the width direction, unlike the perforated line 11, the user can easily identify the notch 11'. Therefore, the packaging film 10 can be cut based on the notch 11' without separately opening and closing the lid 1, so that the packaging film 10 can be easily removed from the container.

The notch 11' may be formed at a height that is aligned with the lower edge of the lid 1, similar to the tear line 11.

The notch 11' may be exemplified in the shape of a sheath placed by cutting the packaging film to a predetermined length in addition to the triangular shape.

The packaging film 10 in the present embodiment is made of a structure that is provided so as to be slipped by simply contacting the container in a portion other than the adhesive means 12.

That is, the lid 1 is adhered by the adhesive means 12, and the body 2 except for the lid 1 is in a state of being in simple contact without being adhered, whereby when the packaging film 10 is removed, problems such as the adhesive means 12 remaining on the surface of the body 2 or the remaining packaging film 10 not yet removed from the adhesive means 12 can be prevented.

On the other hand, the lid 1 is usually formed in a cylindrical shape with a flat upper surface and knurled side surfaces in consideration of reinforcement of gripping force. At this time, if the adhesive means 12 is applied to the side portion of the lid 1, the adhesive strength is reduced by the knurling portion, and sufficient adhesive strength is not guaranteed such that the packaging film 10 is easily falling off, or the adhesive means 12 enters between the knurling grooves, which makes it difficult to remove the adhesive means 12 from the lid 1 later.

In addition, the sides of the lid 1 must be strongly gripped in order to rotate the lid 1, and thus, if the adhesive means 12 is formed on the side surface of the lid 1, it may be stuck between knurling and cannot be easily removed by pressing due to the gripping force of the user's hand in the process of operating the lid 1.

The lid 1 is not used once and then discarded, but must be operated repeatedly several times until the contents in the container are used up. If the adhesive means 12 remains on the lid 1, it causes discomfort due to repeated use, and it is difficult to manage hygienically, such as various dusts easily attached to the surrounding area.

Therefore, in the present embodiment, the side surface of the lid 1 is not provided with the adhesive means 12, and is formed only in a point corresponding to the upper surface of the lid 1, for example, in a circular shape corresponding to the circular upper surface of the lid 1, and thus, has a structure that secures the fixing force of the packaging film 10 and is not easily damaged by repeated use of the lid 1, so that the lid 1 can be removed more easily later.

That is, if the adhesive means 12 is formed only on the upper surface of the lid 1, the grasping force of the hand or the like is not directly transmitted and thus, is not damaged, which facilitates removal of the adhesive means 12. At the same time, no trace of the adhesive means 12 is left on the body 2, so that the quality of the recycled raw material can be guaranteed, and the adhesive means 12 can be more easily removed from the lid 1 later. In addition to the recycling of the body 2, the recycling of the lid 1 can also be fully considered.

Figure 7:
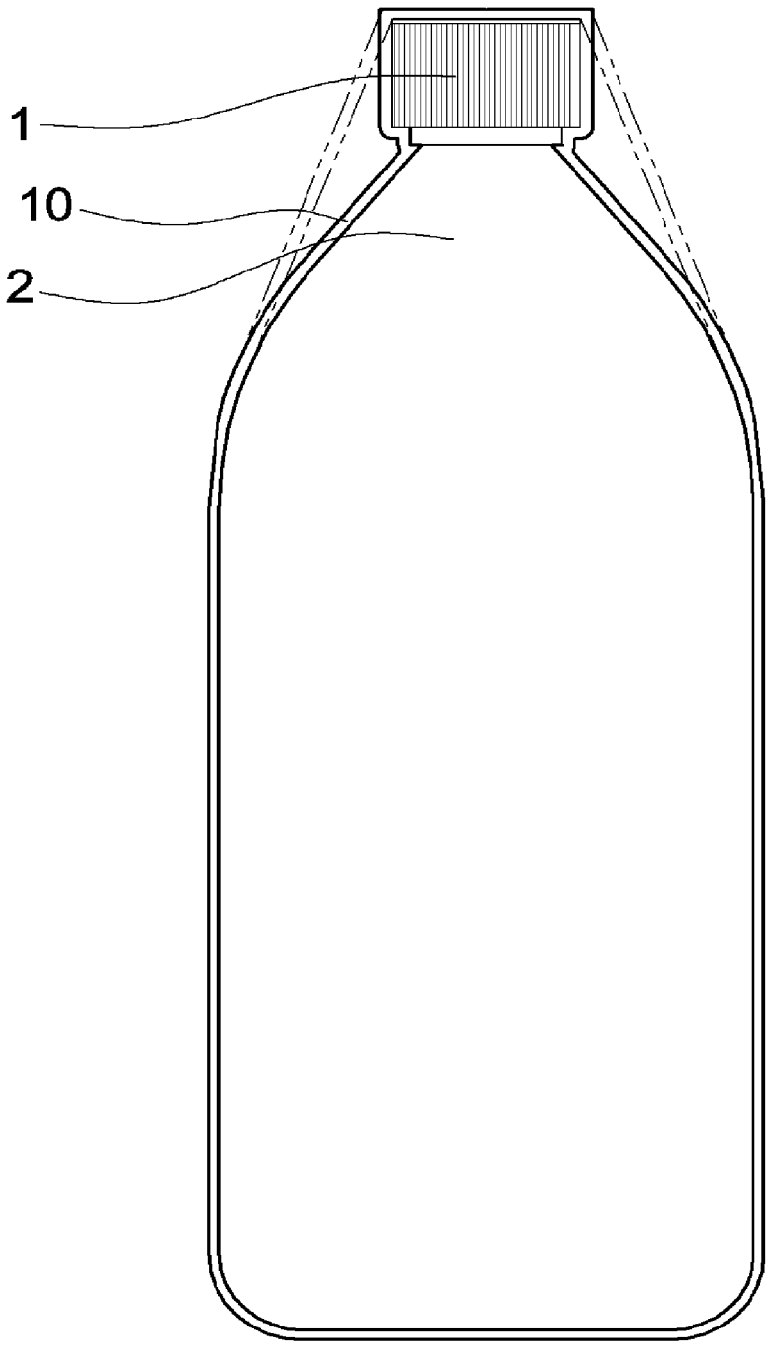
FIG. 7 is a view showing a state in which the container is closely attached to the surface by heat shrinkage.

Meanwhile, in some cases, the packaging film 10 may be adhered to the surface of the container by heat shrinkage as shown in FIG. 7.

When the packaging film 10 in the form of a closed band is wrapped around a container and heat-treated around it, the packaging film 10 is heat-shrunk and can be strongly adhered to the container in response to the shape of the outer surface of the container.

On the other hand, the full width W of the packaging film 10 may be made the same in the entire length of the packaging film 10, and at this time, the full width W of the packaging film 10 is preferably formed equal to or larger than the diameter of the lid 1.

If the full width W of the packaging film 10 is formed smaller than the diameter of the lid 1, it is not possible to secure a sufficient adhesion area for the adhesive means 12 to be formed on the lid 1, so that the adhesive strength of the packaging film 10 cannot be guaranteed, and at the same time, the packaging film 10 cannot sufficiently cover the lid 1. Therefore, a problem occurs in that the portion adhered to the lid 1 is easily peeled off from the lid 1 when the lid 1 is rotated.

On the other hand, the packaging film 10 in this embodiment has a structure in which the packaging film 10 can sufficiently wrap the lid 1, so that a sufficient adhesion area for the bonding means 12 can be secured. Even when rotating the lid 1, the lid 1 can be rotated while the user's hand is in sufficient contact with the packaging film 10, and thus, has a structure that allows the packaging film 10 to be linked more intuitively to the lid 1.

On the other hand, in the above description, an embodiment in which the packaging film 10 has the same overall width W over the entire length has been described. However, when a sufficient amount of advertising phrases are required or when the uniform appearance design of the packaging film 10 is to be changed, the overall width may be configured differently in individual sections of the packaging film 10.

Figure 8:
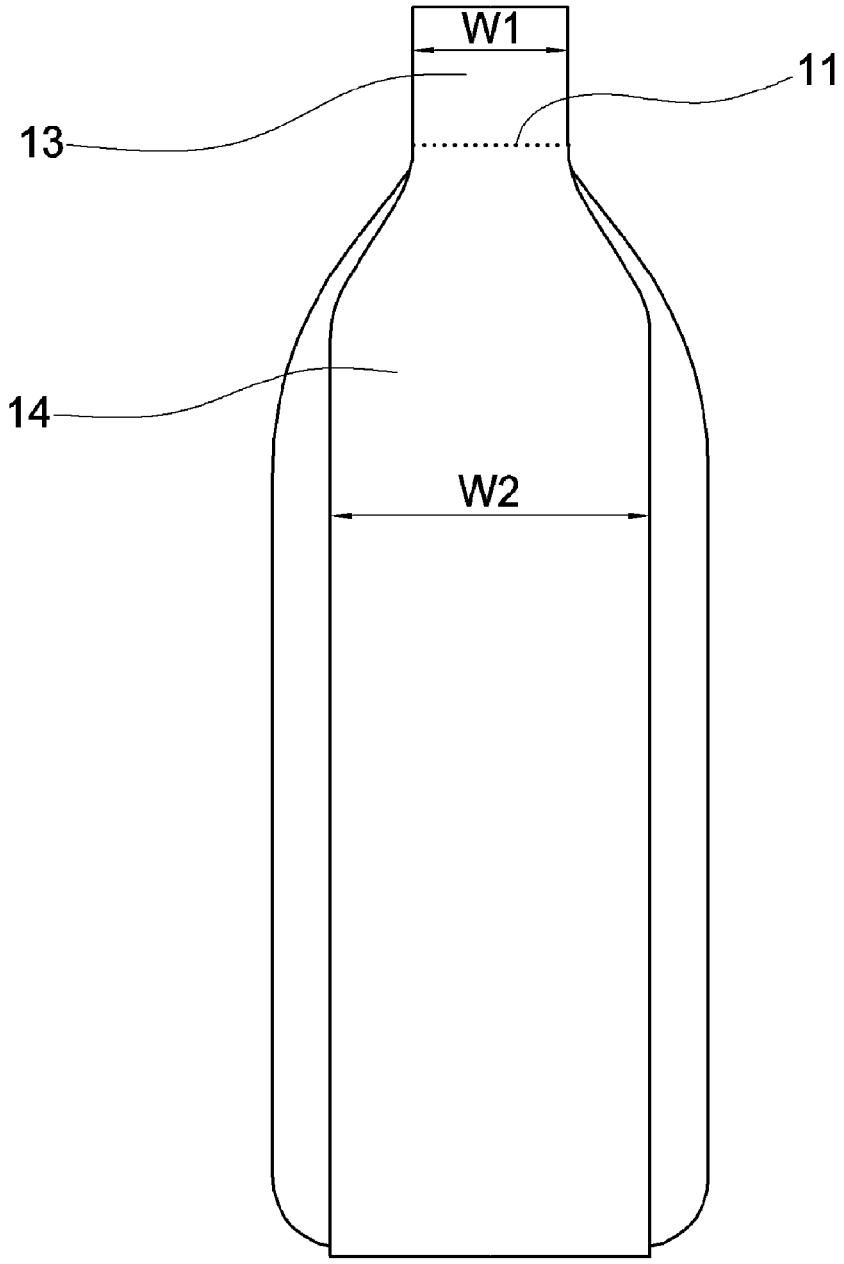
FIG. 8 is a view showing another embodiment of the packaging film according to the present invention.

For example, as shown in FIG. 8, the packaging film 10 constitutes the upper portion of the packaging film 10, and is formed of an upper end 13 that wraps the outer side of the container lid 1 and a lower portion of the upper end 13, which is illustrated as including a middle portion 14 that wraps the outer side of the container body 2, and at this time, the full width W2 of the middle portion 14 may be formed larger than the full width W1 of the upper end portion 13.

That is, by configuring the overall width to gradually widen from the upper portion 13 to the middle portion 14, a sufficient area for inserting an advertisement phrase can be secured in the middle portion 14. The upper part 13 may have a relatively small overall width to prevent waste of raw materials in terms of the production.

At this time, the minimum overall width W1 of the upper end portion 13 is preferably equal to or larger than the diameter of the lid 1.

The perforated line 11 is positioned between the upper end portion 13 and the middle portion 14 to form a boundary line between the upper end portion 13 and the middle portion 14.

On the other hand, in the previously described embodiment, the adhesive means 12 is formed at a point corresponding to the upper surface of the lid 1 so that an adhesive point is formed only on the lid 1, but it will be clarified that in some cases it may be formed on the lower surface of the body 2.

Other embodiments of the present invention will be described below with reference to the accompanying drawings. In order to avoid duplication of description, detailed descriptions of the same or similar parts as those described above will be omitted, and only the differences will be described.

Figure 11:
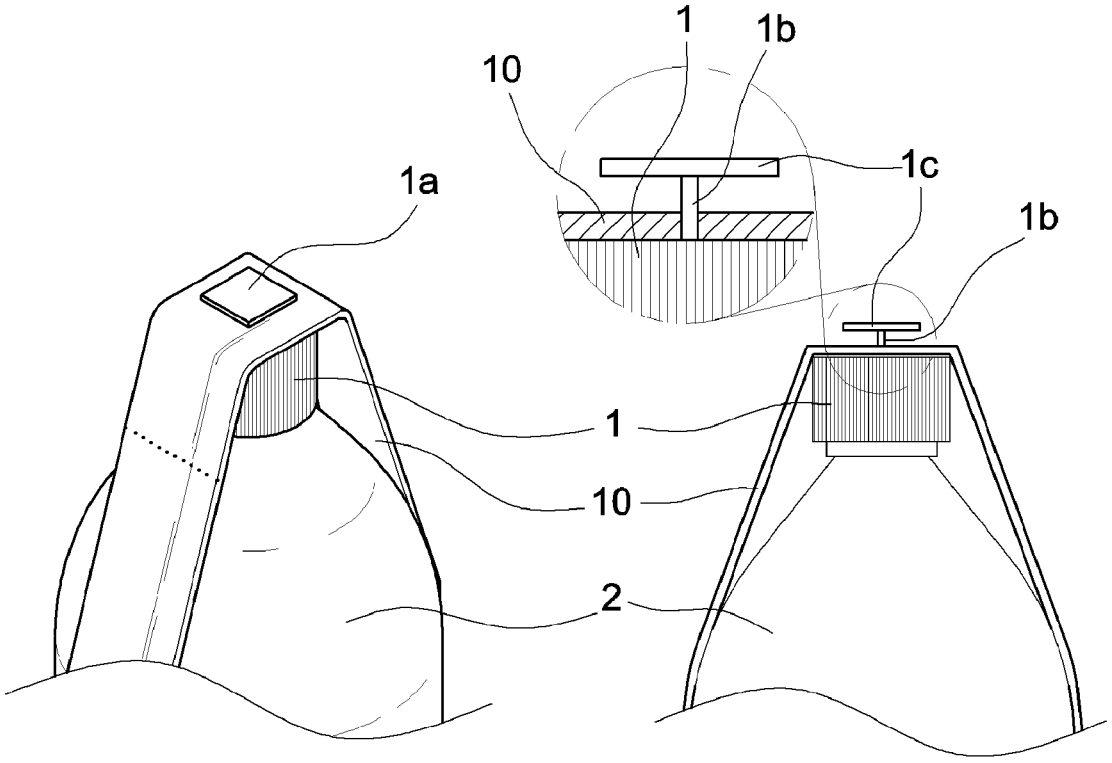
FIGS. 11 to 14 show various modifications of the lid.

First, as shown in FIG. 11, the upper surface of the lid 1 may be formed with an incision protrusion 1*a* to protrude upward.

The incision protrusion 1*a* serves to more firmly fix the packaging film 10 to the lid 1 so that the packaging film 10 can be twisted in conjunction with it when the lid 1 is rotated, and at the same time, plays a role in cutting the packaging film 10 together with the aforementioned perforated line 11.

Due to an unforeseen reason, even if the perforated line 11 does not work when the lid 1 is rotated, the incision protrusion 1*a* tears the packaging film 10, thereby cutting the packaging film 10 by interlocking with the lid 1.

Since the incision protrusion 1*a* is formed on the upper surface of the lid 1, in this embodiment, the adhesive means 12 may be formed on the lower surface of the body 2.

Meanwhile, the packaging film 10 may be formed with an incision opening 15 into which the incision protrusion 1*a* is inserted. At this time, the incision opening 15 may be implemented in such a way that a portion of the packaging film 10 is incised in a form corresponding to the outer shape of the incision protrusion 1*a*.

Accordingly, the incision projection 1*a* has a structure exposed to the outside through the incision opening 15.

Since the incision projection 1*a* penetrates the incision opening 15, when the lid 1 is rotated, the lid 1 winds and pulls the packaging film 10 along the direction of rotation, it has a structure that can more effectively apply torsional deformation to the packaging film 10, and in some cases, the packaging film 10 can be torn based on the cut opening 15, so that the packaging film 10 can be more effectively removed from the container.

As an example, the incision projection 1*a* may be made of a structure including a vertical plate 1*b* erected vertically on the upper surface of the lid 1 and a horizontal plate 1*c* placed parallel to the upper surface of the lid 1 at the upper end of the vertical plate 1*b*.

In this case, the horizontal plate 1*c* is moved in parallel from the upper surface of the lid 1 to the top by a certain distance to serve to cover a certain portion of the cutout 15 of the packaging film 10, so that the rotation of the lid 1 It is possible to some extent prevent the incision 15 from being torn due to unexpected reasons except for the above.

Figure 12:
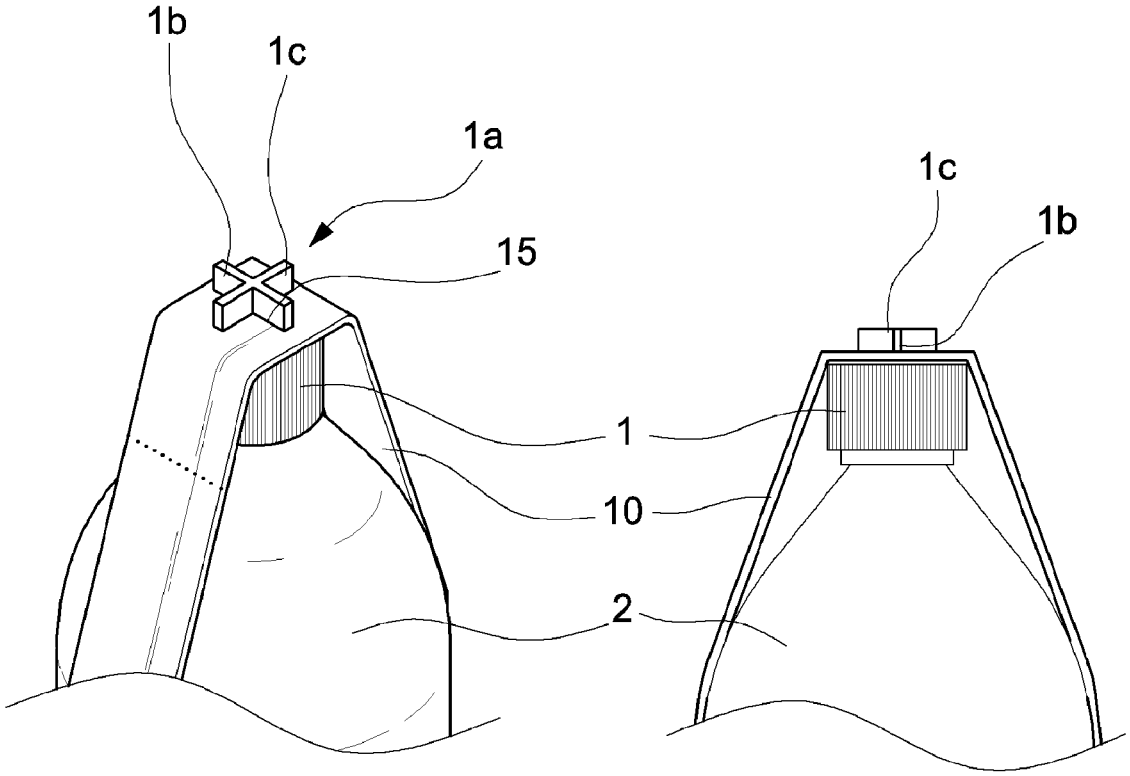

As another example, as shown in FIG. 12, the incision projection 1*a* has a first vertical plate 1*b* vertically erected on the upper surface of the lid 1, and crosses a first vertical plate 1*b* in a direction orthogonal to the first vertical plate 1*b*, so that a structure including a second vertical plate 1*c* erected vertically on the upper surface of the lid 1 can be exemplified. The first vertical plate 1*b* and the second vertical plate 1*c* may cross each other to form a "+" shape.

Figure 13:
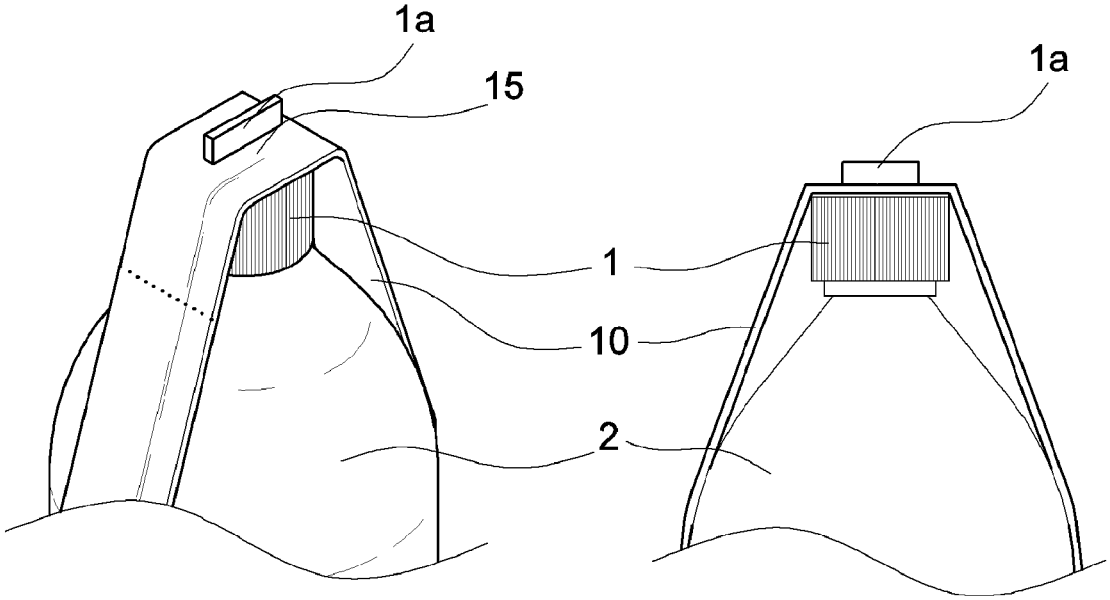

At this time, as shown in FIG. 13, at least one of the first vertical plate 1*b* and the second vertical plate 1*c* may be omitted.

Figure 14:
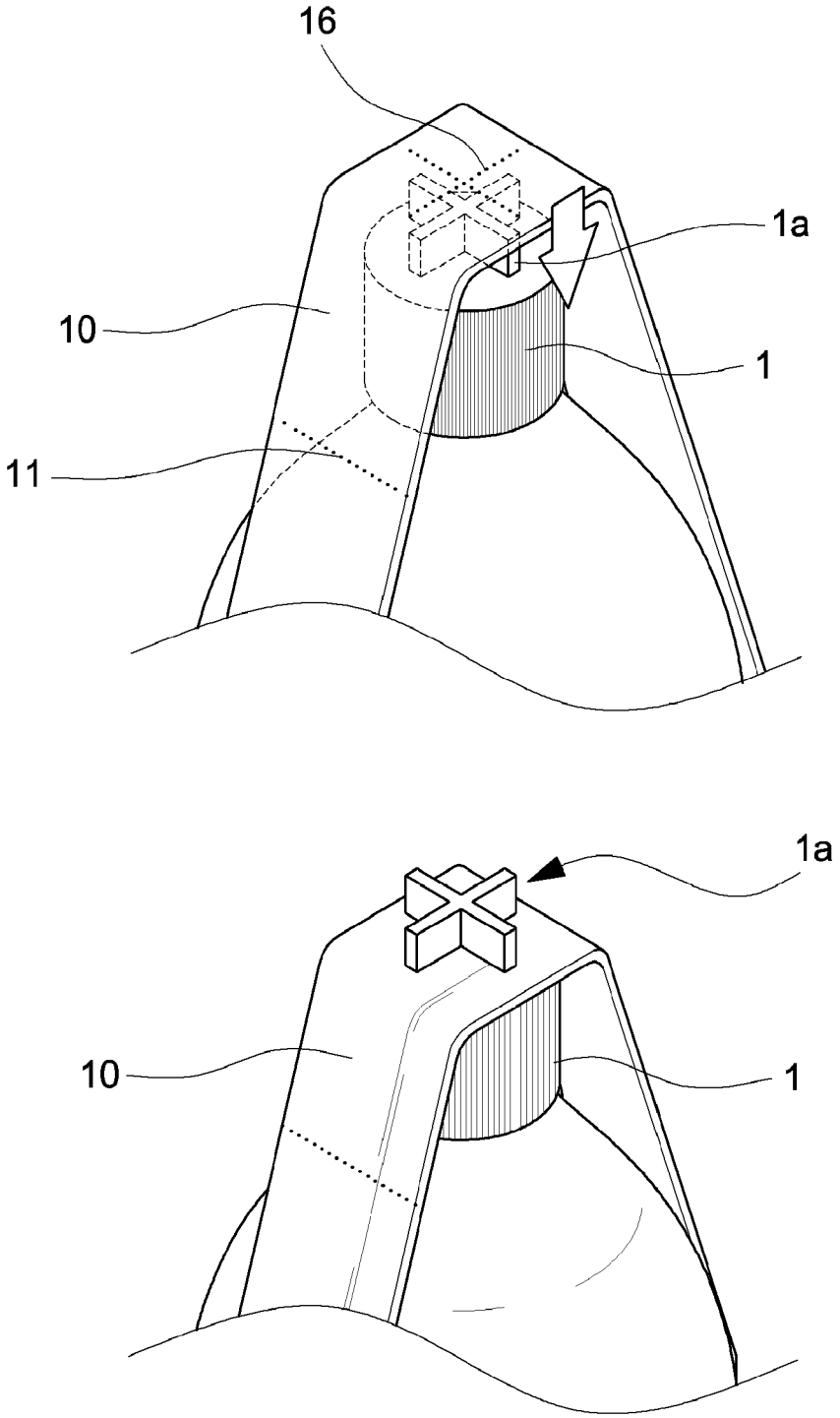

On the other hand, as shown in FIG. 14, the packaging film 10 may cover the incision protrusion 1*a* from the outside. In this case, the packaging film 11 may have an auxiliary perforated line 16 formed at a point corresponding to the incision protrusion 1*a*. That is, when the incision projection 1*a* passes through the auxiliary perforated line 16 depending on the situation, the auxiliary perforated line 16 portion serves as the incision opening 15 described above.

Accordingly, only when it is necessary, the packaging film 10 in the state shown in FIG. 14 is pulled down in the direction of the arrow to penetrate the packaging film 10 through the auxiliary perforated line 16 so that the incision projection 1*a* is exposed to the outside, and then the lid 1 can be rotated. Such a structure is intended to prevent the incision protrusion 1*a* from being arbitrarily exposed during the distribution process of the container.

Figure 15:
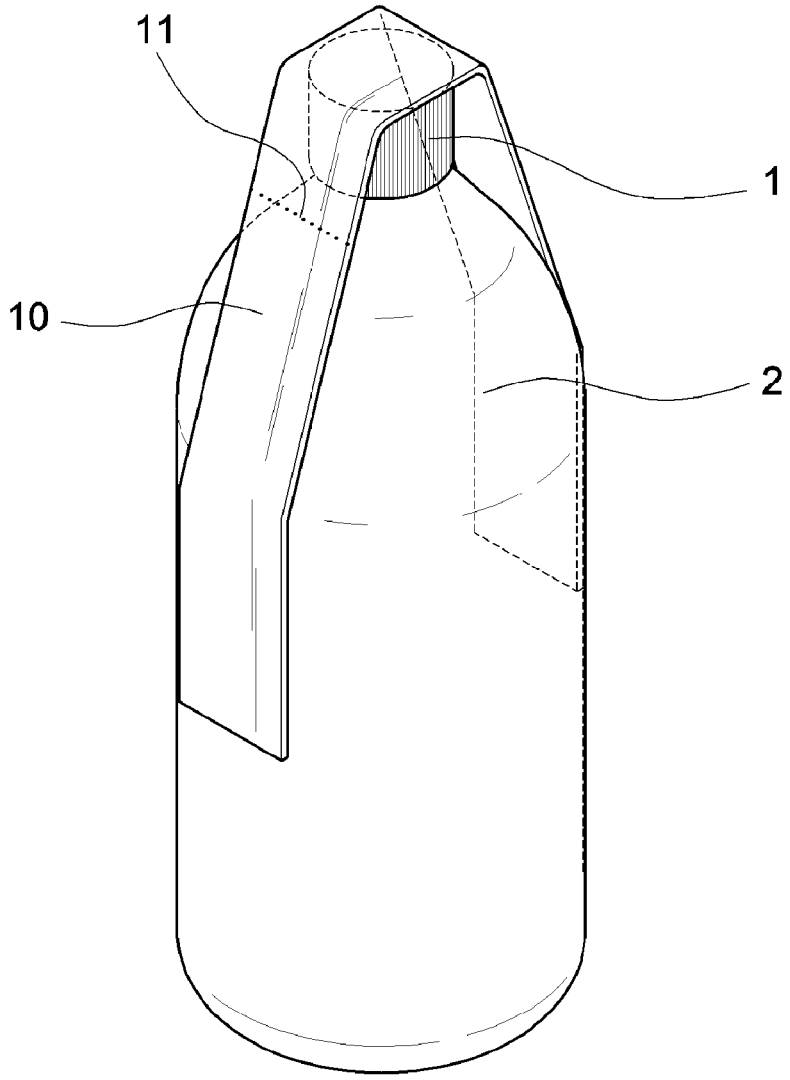
FIG. 15 is a diagram showing another embodiment of the packaging film according to the present invention.

On the other hand, the packaging film 10 does not take the form of a closed band wound in the direction of interconnecting the upper surface of the container lid 1 and the lower surface of the container body 2, but as shown in FIG. 15, at least the upper surface of the lid 1 may be rolled, and then both ends of the free ends may be adhesively fixed to the outer surface of the body 2.

In this case, there is an advantage in reducing manufacturing costs and preventing consumption of raw materials in terms of saving raw materials for the packaging film 10.

Figure 16:
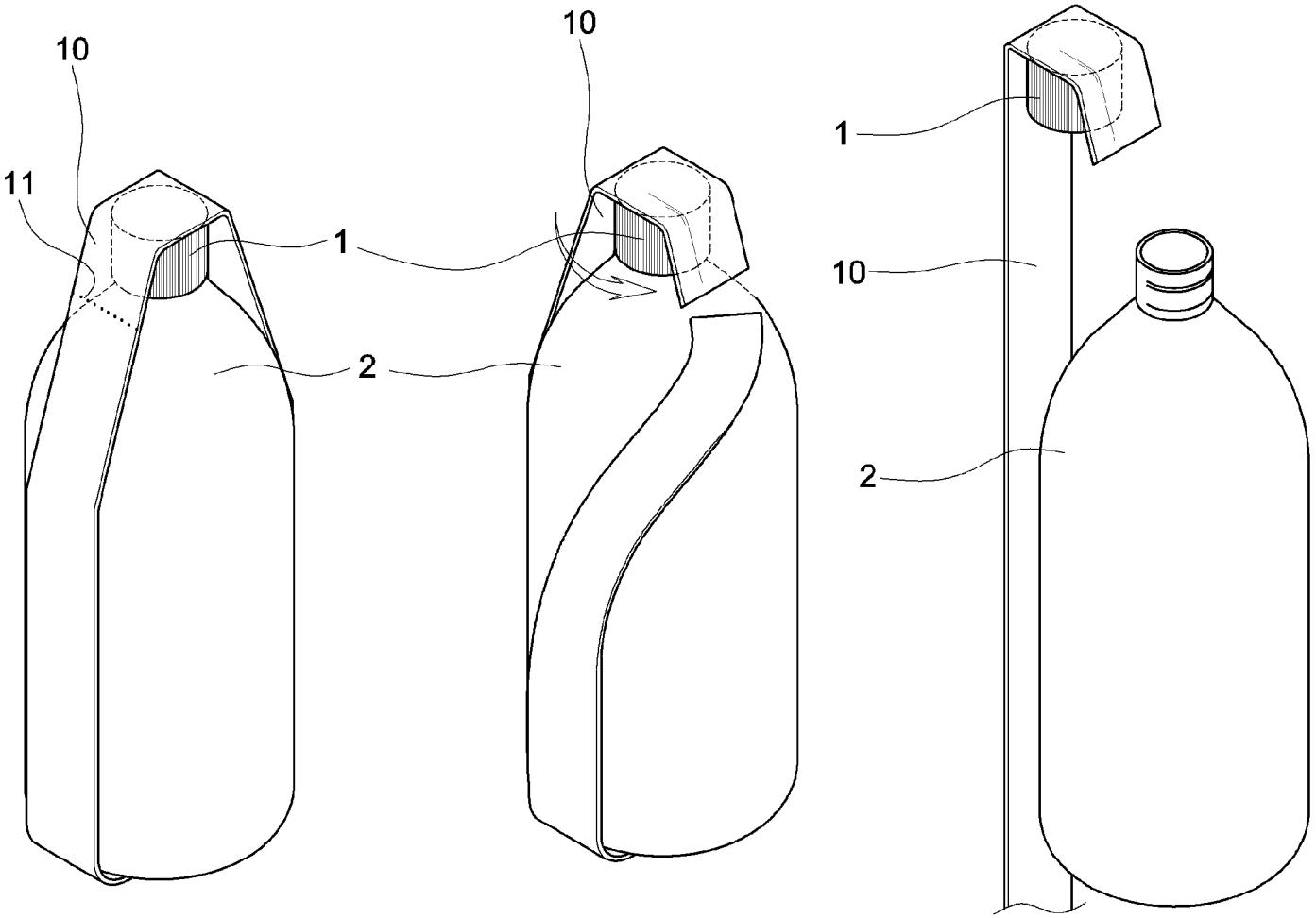
FIG. 16 is a diagram which explains the operation of the packaging film according to the present invention, and shows the process of being removed from the container step by step.

Looking at the operation of the packaging film 10 configured as described above with reference to FIG. 16, first, the container lid 1 is rotated and separated from the container body 2 to unseal the contents sealed in the container.

At this time, the user can grip both sides of the lid 1 via the outer portion of the packaging film 10 wrapping the lid 1, and when the lid 1 is rotated in this state, the upper portion of the packaging film 10 rotates in the same direction in conjunction with the rotation of the lid 1.

That is, since the lower portion of the packaging film 10 is caught on the lower surface of the body 2 and the upper portion of the packaging film 10 rotates together with the lid 1, and twist is applied to the packaging film 10, and the packaging film 10 is cut based on the perforated line 11 by this twisting deformation.

At this time, since the packaging film 10 is in a state of being simply in contact with the body 2 without forming an adhesion point, it is easily peeled off on the body 2 and when the lid 1 is completely removed from the body 2, the packaging film 10 can be removed from the container therewith.

That is, the packaging film 10 can be easily removed by a one-touch rotating operation of the lid 1, the troublesome act of consciously removing the packaging film 10 can be fundamentally omitted. Since the packaging film 10 can be forcibly removed by opening the contents of the container, the packaging film 10 can necessarily be removed from the container after use even if there is no intention to remove the packaging film 10.

Therefore, the recovery rate of the containers from which the packaging film 10 has been removed can be increased, and the recycling of the containers becomes easier.

The embodiments of the present invention described above are merely exemplary, and those skilled in the art will appreciate that various modifications and equivalent other embodiments can be made therefrom. Therefore, it will be well understood that the invention is not limited to only the forms referred to in the foregoing detailed description. Therefore, the true technical scope of protection of the present invention should be determined by the technical ideas of the attached claims. In addition, it should be understood that the present invention includes all modifications, equivalents and alternatives falling within the spirit and scope of the invention as defined by the appended claims.

The invention claimed is:

1. A container comprising:

a body, a lid coupled to an upper end of the body, and a packaging film that wraps an outer side of the container, wherein:

the packaging film is in a form of a closed band that continuously wraps around an upper surface of the lid, a lower surface of the body and both facing sides of the body, wherein both sides of the body that are not wrapped in the packaging film are completely opened, and an adhesive point is formed only on the lid so that it is separated from the container when the lid is rotated, an adhesive means is provided on an inner surface of the packaging film that contacts the lid, and attached and fixed to an outer surface of the lid, and the adhesive means is formed in a circular shape at a point corresponding to the upper surface of the lid, wherein a perforated line is provided on a path of the packaging film, and the perforated line is cut and the packaging film is separated from the body when the lid is rotated, wherein the upper surface of the lid is formed with an incision protrusion that protrudes upward.

2. The container of claim 1, wherein:

the packaging film comprises an upper end portion that forms an upper portion of the packaging film and wraps around the outer side of the lid; and a middle portion formed at a lower portion of the upper end portion and wrapping the outer side of the body, wherein the perforated line constitutes a boundary point between the upper end portion and the middle portion, and wherein a full width of the middle portion is formed larger than a full width of the upper end portion.

3. The container of claim 1, wherein:

the packaging film is formed with an incision opening into which the incision protrusion is inserted, and the incision protrusion passes through the incision opening and is exposed to the outside.

* * * * *